United States Patent [19]

Schadenberg

[11] 4,062,788

[45] Dec. 13, 1977

[54] LUBRICATING COMPOSITIONS CONTAINING A DI(CHLOROPHENYL) ESTER OF AN ALIPHATIC DICARBOXYLIC ACID

[75] Inventor: Hendrik Schadenberg, Amsterdam, Netherlands

[73] Assignee: Shell Oil Company, Houston, Tex.

[21] Appl. No.: 714,552

[22] Filed: Aug. 16, 1976

[30] Foreign Application Priority Data

Sept. 5, 1975 United Kingdom ..... 36627/75

[51] Int. Cl.[2] ..... C10M 1/30; C10M 3/24; C10M 5/18

[52] U.S. Cl. ..... 252/54.6; 560/130; 560/146

[58] Field of Search ..... 260/479 S; 252/54.6

[56] References Cited

U.S. PATENT DOCUMENTS

| | | | |
|---|---|---|---|
| Re. 22,189 | 9/1942 | Prutton et al. | 252/54.6 |
| 2,255,085 | 9/1941 | Prutton et al. | 252/54.6 |
| 3,260,736 | 7/1966 | Martin | 260/479 S |
| 3,689,529 | 9/1972 | Lehureau et al. | 260/479 S |
| 3,691,077 | 9/1972 | Wann et al. | 252/54.6 |
| 3,790,622 | 2/1974 | Nicholson | 260/479 S |

FOREIGN PATENT DOCUMENTS

| | | | |
|---|---|---|---|
| 558,049 | 5/1958 | Canada | 260/479 S |
| 9,573 | 7/1962 | Japan | 260/479 S |

OTHER PUBLICATIONS

C. A. Buehler et al.; *Survey of Organic Synthesis,* 1970, pp. 807–808.

*Primary Examiner*—Delbert E. Gantz
*Assistant Examiner*—J. Thierstein
*Attorney, Agent, or Firm*—Ronald R. Reper

[57] ABSTRACT

Lubricating compositions are provided which comprise a major amount of oil of lubricating viscosity and an effective amount of dichlorophenyl esters of hydrocarbyl dicarboxylic acids. The lubricating compositions have improved load-bearing properties. Also provided are novel dichlorophenyl esters of malonic and lower alkyl substituted malonic acid.

6 Claims, No Drawings

LUBRICATING COMPOSITIONS CONTAINING A DI(CHLOROPHENYL) ESTER OF AN ALIPHATIC DICARBOXYLIC ACID

BACKGROUND OF THE INVENTION

The invention relates to lubricating compositions having improved load-bearing properties.

It is known to add compounds to lubricants in order to improve the load-bearing properties e.g. extreme pressure and/or anti-wear properties thereof. A commercially successful class of such compounds is the zinc dialkyldithiophosphates. The applicants have now discovered a class of compounds which is superior to the zinc dialkyldithiophosphates for this purpose.

SUMMARY OF THE INVENTION

The lubricating compositions of this invention comprise a lubricating base oil and an effective amount of a di(chlorophenyl)ester of a hydrocarbyl dicarboxylic acid. These lubricating compositions are particularly valuable since they provide excellent load-bearing lubrication.

The invention further provides a process for preparing a dichlorophenyl ester of a hydrocarboxylic acid which process comprises reacting a compound of the general formula

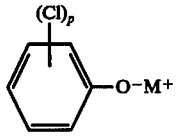

wherein $p$ is an integer from 1 to 5 and M+ is a metal ion, with a hydrocarbyl dicarboxylic acid chloride. The invention further provides as novel compounds di(chlorophenyl)esters of malonic acid or lower alkyl substituted malonic acid.

DESCRIPTION OF PREFERRED EMBODIMENTS

The lubricating compositions according to the invention comprise di(chlorophenyl)esters of hydrocarbyl dicarboxylic acids. By the term "hydrocarbyl" is meant that the dicarboxylic acids from which the esters are prepared, may contain in addition to the two carboxylic acid groups only carbon and hydrogen atoms. Preferred hydrocarbyl groups contain from 2 to 15 carbon atoms. Suitably these compounds are esters of aliphatic dicarboxylic acids, particularly $C_2$ and $C_{15}$ dicarboxylic acids, such as esters of oxalic, glutaric and adipic acid. The esters of malonic acid or alkyl malonic acids are novel compounds. Preferably, the two chlorophenyl groups contain, in total from 4 to 10 chlorine atoms, with those containing 10 chlorine atoms being most preferred. Preferably the esters are bis(chlorophenyl)esters of hydrocarbyl dicarboxylic acids. Preferred esters are those of the general formula:

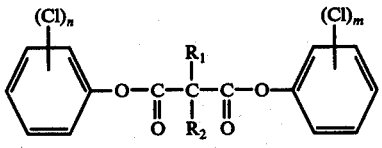

wherein $m$ and $n$ are integers of from 1 to 5 and preferably $m$ equals $n$; and wherein $R_1$ and $R_2$, which may be the same or different, are hydrogen or lower alkyl, e.g. $C_1$ and $C_6$ alkyl groups. The most preferred ester is bis(pentachlorophenyl)malonic acid.

The chlorophenyl groups may, in the case where either $m$ and/or $n$ is not 5, be substituted by groups such as lower alkyl groups.

The di(chlorophenyl)esters which may be prepared by any suitable technique are preferably prepared by reacting the corresponding phenoxide i.e. a compound or mixture of compounds of the general formula:

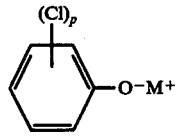

wherein $p$ is an integer of from 1 to 5 and M+ is a metal ion, e.g. sodium, with the corresponding hydrocarbyl dicarboxylic acid chloride such as e.g. malonyl dichloride, preferably in the presence of a hydrocarbon solvent such as toluene. The metal ion is preferably a group I metal ion.

The phenoxide itself is suitably prepared by reacting a chlorophenol with a suitable metal or metal hydroxide such as sodium or sodium hydroxide.

The lubricating compositions according to the invention comprise a major amount of oils of lubricating viscosity. The base oil for these lubricants generally is a lubricating oil fraction of petroleum, either naphthenic or paraffinic base, unrefined, acid-refined, hydrotreated or solvent refined as required by the particular lubricating need. Also, synthetic oils such as ester lubricating oils and mixtures thereof meeting the viscosity requirements either with or without viscosity improvers, may be used as base stock. Preferably, the lubricating base oil is mineral oil including lubricating oils of low, medium, high or very high viscosity.

The effective amount of di(chlorophenyl)ester of a hydrocarbyl carboxylic acid additive present in the lubricant compositions of this invention may vary between wide limits but is suitably between 0.01 and 10%wt with amounts of from 0.1 to 2%wt being usual.

The lubricating compositions according to the invention may contain a number of other additives. Often included in such lubricating compositions are viscosity improving agents. Normally these are high molecular weight polymers such as hydrocarbon polymers such as polyisobutylene, hydrogenated styrene-butadiene or ethylene-propylene copolymers. Other viscosity improving agents are acrylate polymers such as copolymers of alkyl methacrylate with vinyl pyrrolidone available under the trade name "acryloid" from Rohm & Haas. The viscosity index improver will normally be present in amounts from about 2 to about 10 percent of the base oil. Other additives which can be included are antifoam agents such as various silicone and fluorosilicone compounds commercially available; dispersants, which may be of the ash or ashless type, pour point depressants; anti-oxidants, metal passivators and anti-corrosion agents. Some additives as is well known in the art are multifunctional, for example, oil soluble overbased Group III metal salts of a hydrocarbyl sulfonic acid are known to impart inter alia, thermal stability, oxidation inhibition and rust inhibition.

If desired, in addition to the present load-bearing additives, the lubricating composition may include other compounds having a load-bearing action such as tricresyl phosphate.

The invention will now be illustrated by reference to the following examples.

EXAMPLE 1

Preparation of bis(pentachlorophenyl)malonate

Pentachlorophenol (300 g; 1.04 mole) was refluxed under nitrogen with toluene (3 L) until water was no longer distilled. Sodium (25 g; 1.08 mole) was then slowly added and refluxing, under nitrogen, continued for 72 hours. Malonyldichloride (73.5 g; 0.52 mole) in dry toluene (100 ml) was slowly added to the mixture and refluxing continued for 1 hour. The precipitate was removed and the filtrate cooled to about −10° C. The product was allowed to crystallize out overnight, isolated and dried. The yield of bis(pentachlorophenyl)malonate was 220 g (70%) and it had a melting point of 205.5° to 207° C.

The IR-spectrum of the product was in agreement with a compound having the above structure.

Elemental Analysis: Calculated: C-30%, H-0.3%, Cl-59%; Found: C-30.2; H-0.4; Cl-58.3%.

EXAMPLE 2

Preparation of bis(trichlorophenyl)malonate

Example 1 was repeated using trichlorophenol instead of pentachlorophenol. The yield of bis(trichlorophenyl)malonate was 10.5 g (44.5% and it had a melting point of 155° to 157° C.

The IR-spectrum of the product was in agreement with a compound having the above structure.

Elemental Analysis: Calculated: C-39%, H-1.3%, Cl-46%; Found: C-39%, H-1.4%, Cl-46%.

EXAMPLE 3

Preparation of bis(pentachlorophenyl)methylmalonate

Example 1 was repeated using methyl malonyl dichloride. The yield of bis(pentachlorophenyl)methylmalonate was 5 g (20%) and it had a melting point of 144° to 146° C.

The IR-spectrum of the product was in agreement with a compound having the above structure.

Elemental Analysis: Calculated: C-31.2%, H-0.6%, Cl-57.8%; Found: C-31%, H-0.8%, Cl-58%.

EXAMPLES 4 TO 8

Lubricating oil compositions were prepared as follows:

Qatar Marine base oil (HVI 60) — balance

Styrene/hydrogenated butadiene copolymer (VI improver) — 3.2%wt

Polyisobutylene/maleic anhydride/pentaerythritol (dispersant) 2.8%w (a.m.)

Extreme-pressure additive — 1.0%.

The extreme-pressure additives used were a. bis(pentachlorophenyl)malonate (Example 4), b. bis(trichlorophenyl)malonate (Example 5), c. bis(pentachlorophenyl)methylmalonate (Example 6) and d. a commercial zine dialkyldithiophosphate (Example 7).

A similar composition to the above, but not containing an extremepressure additive, was also tested (Example 8).

The oil compositions were tested in a Cam and Tappet Rig. The rig comprises three housings in each of which are rotably mounted cams made from induction hardened cast iron. A tappet, made of chilled case iron, is in forced contact with each cam. The area of contact between each tappet and rotating cam is lubricated by means of the oil composition which is pumped between each tappet and rotating cam and then allowed to drain from the housing back into the reservoir. During the test the cam rotates at about 1500 revs/min under a static tappet load, when the cam is at top position, of 200 kg.f. The oil temperature is maintained at about 80° C. and about 700 g of oil are used in the test. The test is carried out for a period of 20 hours after which the cam and tappets are replaced and the test continued, using the used oil, for a further period of 20 hours.

The cams are weighed before and after the test and the weight loss of each cam is calculated. The tappets are also visually examined to see whether pitting has occurred. Sometimes a cam fails completely which can be observed by an increase in oil temperature at the oil outlet port of the housing; in these cases the time elapsed before failure is also noted.

The results are given in Table I.

TABLE I

| Ex. | Number of Experiments | Average cam wear (mg) | % tappets with pitting | % failed cams | Average time before failure (hrs) |
|---|---|---|---|---|---|
| 4 | 12 | 0 | 0 | 0 | — |
| 5 | 6 | 8 | 0 | 0 | — |
| 6 | 6 | 24 | 0 | 0 | — |
| 7 | 6 | 840 | 67–83 | 17 | 1 |
| 8 | 15 | 3860 | 0 | 60 | 2 |

EXAMPLE 9

A lubricating oil was prepared as follows:

| | |
|---|---|
| Qatar Marine base oil (HVI 60) | balance |
| Styrene/hydrogenated butadiene copolymer (VI improver) | 3.2 % wt |
| Polyisobutylene/maleic anhydride/pentaerythritol (dispersant) | 2.75 % wt a.m. |
| 4,4'-methylene-bis(2,6-di-tertiary butylphenol)-antioxidant | 0.5 % wt |
| A poly(alkyl)acrylate(pour-point depressant) | 0.5 % wt |
| Heterocyclic polysulphide (metal passivator) | 0.1 % wt |
| Petroleum sulphonate (dispersant) | 1.5 % wt |
| Bis(pentachlorophenyl)malonate | 1.0 % wt |

The composition was tested in the Petter W-1 bearing corrosion test (IP method 176/69) and the result, expressed in bearing weight loss, was 6 mg after 36 hours, 9 mg after 48 hours and 12 mg after 60 hours.

What is claimed is:

1. A lubricating composition comprising a lubricating base oil and an amount between 0.01 and 10%wt of a di(chlorophenyl)ester of an aliphatic dicarboxylic acid containing from 2 to 15 carbon atoms, which acid contains in addition to the two carboxylic acid groups only carbon and hydrogen groups.

2. A composition as in claim 1, wherein the ester contains from 4 to 10 chlorine atoms.

3. A lubricating composition as in claim 1, wherein the ester is a bis(chlorophenyl)ester.

4. A composition as in claim 2, wherein the ester is bis(pentachlorophenyl)ester of malonic acid.

5. A lubricating composition comprising a lubricating base oil and an amount between 0.01 and 10%wt of a di(chlorophenyl)ester of malonic or an alkyl malonic acid containing up to 15 carbon atoms.

6. A lubricating composition comprising a lubricating base oil and an amount between 0.01 and 10%wt of an ester of the general formula:

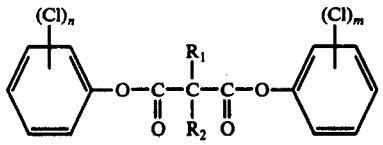

wherein $m$ and $n$ are integers in the range from 1 to 5 and $R_1$ and $R_2$, which may be the same or different, are hydrogen or $C_1$ to $C_6$ alkyl groups.

* * * * *